US008303436B2

(12) United States Patent
Sullivan et al.

(10) Patent No.: US 8,303,436 B2
(45) Date of Patent: Nov. 6, 2012

(54) GOLF BALL HAVING MOISTURE BARRIER LAYERS MADE FROM POLYOLEFIN COMPOSITIONS

(75) Inventors: Michael J. Sullivan, Barrington, RI (US); Brian Comeau, Berkley, MA (US)

(73) Assignee: Acushnet Company, Fairhaven, MA (US)

( * ) Notice: Subject to any disclaimer, the term of this patent is extended or adjusted under 35 U.S.C. 154(b) by 496 days.

(21) Appl. No.: 12/413,807

(22) Filed: Mar. 30, 2009

(65) Prior Publication Data

US 2010/0248862 A1 Sep. 30, 2010

(51) Int. Cl.
*A63B 37/00* (2006.01)

(52) U.S. Cl. ..... 473/351; 473/373

(58) Field of Classification Search ..... 473/351, 473/373, 374

See application file for complete search history.

(56) References Cited

U.S. PATENT DOCUMENTS

| | | | | |
|---|---|---|---|---|
| 5,820,488 | A | 10/1998 | Sullivan et al. | |
| 6,232,389 | B1 | 5/2001 | Feeney et al. | |
| 6,398,668 | B1 | 6/2002 | Wai | |
| 6,632,147 | B2 * | 10/2003 | Cavallaro et al. | 473/374 |
| 6,838,028 | B2 | 1/2005 | Hogge et al. | |
| 6,932,720 | B2 | 8/2005 | Hogge et al. | |
| 7,004,854 | B2 * | 2/2006 | Hogge et al. | 473/374 |
| 7,182,702 | B2 | 2/2007 | Hogge et al. | |
| 7,306,528 | B2 | 12/2007 | Jordan | |
| 7,357,733 | B2 | 4/2008 | Hogge et al. | |
| 2003/0069082 | A1 | 4/2003 | Sullivan | |
| 2003/0069085 | A1 | 4/2003 | Hogge et al. | |
| 2003/0130062 | A1 | 7/2003 | Morgan et al. | |
| 2004/0147344 | A1 | 7/2004 | Sullivan | |
| 2004/0185963 | A1 | 9/2004 | Hogge et al. | |
| 2006/0068938 | A1 | 3/2006 | Sullivan | |
| 2006/0128505 | A1 | 6/2006 | Sullivan et al. | |
| 2007/0129172 | A1 | 6/2007 | Cavallaro | |
| 2008/0064528 | A1 | 3/2008 | Jordan | |
| 2008/0261721 | A1 | 10/2008 | Hogge et al. | |

* cited by examiner

*Primary Examiner* — Raeann Gorden
(74) *Attorney, Agent, or Firm* — Daniel W. Sullivan

(57) ABSTRACT

A multi-layered golf ball having a core, moisture vapor barrier layer, and outer cover, wherein the moisture barrier layer is preferably made from a non-ionomeric polyolefin composition is disclosed. The moisture barrier layer is applied at very low thickness, preferably in the range of 0.0001 to 0.010 inches, so that the playing performance properties of the ball are not altered. Preferably, the moisture vapor barrier layer is applied over the core material using powder coating or solution coating methods.

5 Claims, 2 Drawing Sheets

GOLF BALL HAVING MOISTURE BARRIER LAYERS MADE FROM POLYOLEFIN COMPOSITIONS

BACKGROUND OF THE INVENTION

1. Field of the Invention

The present invention relates generally to a multi-layered golf ball having a core, a thin moisture vapor barrier layer, and an outer cover, wherein the moisture barrier layer is preferably made from a non-ionomeric polyolefin composition. The thickness of the moisture barrier layer is preferably in the range of 0.0001 to 0.010 inches. Preferably, the moisture barrier layer is applied by a powder coating or solution coating method.

2. Brief Review of the Related Art

Golf balls having solid inner cores made from a polybutadiene rubber material cross-linked with peroxide and/or zinc diacrylate are common in the industry. The inner core primarily provides resiliency to the golf ball. One problem with such golf balls is that water vapor may permeate into the cores and harmfully affect the core's properties. As the core absorbs water, it tends to lose its resiliency. The compression and coefficient of restitution (COR) of the ball may be reduced significantly as water enters the core.

The compression value of a golf ball or a golf ball subassembly (for example, golf ball core) is an important property affecting the ball's playing performance. For example, the compression of the core can affect the ball's spin rate off the driver as well as the "feel" of the ball as the club face makes impact with the ball. In general, balls with relatively low compression values have a softer feel. As disclosed in Jeff Dalton's *Compression by Any Other Name, Science and Golf IV, Proceedings of the World Scientific Congress of Golf* (Eric Thain ed., Routledge, 2002) ("J. Dalton") several different methods can be used to measure compression including Atti compression, Riehle compression, load/deflection measurements at a variety of fixed loads and offsets, and effective modulus. For purposes of the present invention, "compression" refers to Atti compression and is measured according to a known procedure, using an Atti compression device, wherein a piston is used to compress a ball against a spring. The test methods for measuring compression of the ball in accordance with the present invention are described in further detail below.

The "coefficient of restitution" or "COR" of a golf ball means the ratio of a ball's rebound velocity to its initial incoming velocity when the ball is fired out of an air cannon into a rigid vertical plate. The COR for a golf ball is written as a decimal value between zero and one. A golf ball may have different COR values at different initial velocities. The United States Golf Association (USGA) sets limits on the initial velocity of the ball so one objective of golf ball manufacturers is to maximize the COR under these conditions. Balls with a higher rebound velocity have a higher COR value. Such golf balls rebound faster, retain more total energy when struck with a club, and have longer flight distance. In general, the COR of the ball will increase as the hardness of the ball is increased. The test methods for measuring compression of the ball in accordance with the present invention are described in further detail below.

The surface hardness of the golf ball is another significant property considered in ball design and construction. Surface hardness generally refers to the firmness of the ball. The test methods for measuring surface hardness of the ball in accordance with the present invention are described in further detail below.

The industry has attempted to address the problem of moisture penetrating into the core layer by applying a barrier layer over the core. The moisture vapor barrier layer encapsulates the core to protect it from the negative effects of moisture. Some materials for making moisture vapor barrier layers are described in the patent literature.

For example, Sullivan et al., U.S. Pat. No. 5,820,488 discloses golf balls having a solid inner core, an outer core, and a water vapor barrier layer disposed therebetween. The water vapor barrier layer preferably has a water vapor transmission rate lower than that of the cover layer. The water vapor barrier layer is formed from polyvinylidene chloride, vermiculite, or a barrier-forming material disposed on the core through an in situ reaction.

Feeney U.S. Pat. No. 6,232,389 discloses a barrier layer for an air or other gas-filled sports balls including golf balls. The barrier layer is formed from an aqueous solution of an elastomer, a dispersed exfoliated layered filler, and a surfactant.

Wai, U.S. Pat. No. 6,398,668 discloses golf balls having a polybutadiene core and an oxygen barrier layer disposed over the core. The barrier layer is made of an ethylene vinyl alcohol copolymer film.

Cavallaro et al., U.S. Pat. No. 6,632,147 and Hogge et al., U.S. Pat. No. 6,838,028 discloses golf balls having an intermediate moisture vapor barrier layer that may be made from (i) multi-layer thermoplastic films including polypropylene films, which have been metallized or coated with polyvinylidene chloride (PVDC), (ii) blends of ionomers, polyvinyl alcohol copolymer and polyamides, and (iii) dispersions of acid salts of polyetheramines, among others.

Hogge et al., U.S. Pat. No. 6,932,720 discloses golf balls having moisture vapor barrier layers made of butyl rubber. The butyl rubber may also be a halogenated butyl rubber such as bromobutyl rubber or chlorobutyl rubber. The butyl rubber may also be a sulfonated butyl rubber. The butyl rubber may be blended with other polymers, such as double bond-vulcanizable rubber, ethylene propylene diene monomer rubber and vinylidene chloride. The moisture barrier layer also may be formed from a composition comprising an elastomer, preferably in combination with a double-bond vulcanizable rubber. The elastomer may comprise at least a conjugated multi-olefin or an iso-olefin. The elastomer may be halogenated, sulfonated, or both. The elastomer may also comprise branched styrenic blocks.

Hogge et al., U.S. Pat. No. 7,004,854 discloses a golf ball having a core, intermediate barrier layer, and cover, wherein the barrier layer has a moisture vapor transmission rate lower than the cover. The barrier layer is formed of a thermoplastic or thermoset composition comprising microparticles, such as fibers, whiskers, metal flakes, micaceous particles, nanoparticles, or combinations thereof, dispersed in a binder comprising synthetic rubbers, natural rubbers, polyolefins, styrenic polymers, single-cite catalyzed polymers, or combinations thereof. The thickness of the barrier layer may be in the range of about 0.001 inches to about 0.01 inches.

Hogge et al., U.S. Pat. No. 7,182,702 discloses a golf ball having a moisture vapor barrier layer that is formed from a composition comprising an elastomer (for example, halogentated butyl rubber) and a double-bond vulcanizable rubber that is cured by infra red radiation or a combination of infra red and ultra violet radiation.

Jordan, U.S. Pat. No. 7,306,528 discloses a golf ball having a moisture vapor barrier layer comprising a blend of a non-ionomeric acid terpolymer (ethylene, a softening acrylate class ester such as methyl acrylate, n-butyl-acrylate or iso-butyl-acrylate, and a carboxylic acid such as acrylic acid or methacrylic acid) and a copolymer (ethylene and methacrylic acid). The '528 patent further discloses that Nucrel™ copolymers of ethylene and methacrylic acid (DuPont) can be used.

Hogge et al., U.S. Pat. No. 7,357,733 discloses moisture vapor barrier layers made from compositions comprising a filler dispersed in a liquid or solvent-borne elastomeric polymer of multi-olefin, iso-olefin, or a combination thereof. Suitable elastomers include brominated polymers derived from a copolymer of isobutylene (IB) and p-methylstyrene (PMS). A copolymer of isobutylene and isoprene with a styrene block copolymer branching agent also can be used.

Although the foregoing materials can provide an effective barrier to moisture penetration, they may need to be applied at relatively high thickness in order to do so. One problem with applying relatively thick layers of the material tom make the barrier layer is that this may cause other desirable properties of the golf ball to degrade. In other words, the relatively thick barrier layers may be effective in preventing moisture penetration, but this potential benefit can be offset by a loss in the ball's playing performance properties. For example, if the layer is too thick, it will contribute to the ball having reduced COR; hence, the ball will have reduced flight distance. Thus, it would be desirable to develop a golf ball having a moisture vapor barrier layer that can be applied thinly, that is at a thickness sufficient to prevent the penetration of moisture into the core, but that does not degrade the playing performance of the ball. The present invention provides golf balls having such characteristics as well as other advantageous properties, features, and benefits. The invention also encompasses methods for making such golf balls.

SUMMARY OF THE INVENTION

The present invention is generally directed to a multi-layered golf comprising a core, a moisture vapor barrier layer enveloping the core, and a cover material enveloping the barrier layer. The core is made of a first composition, for example, natural or rubber. A core comprising polybutadiene is particularly preferred. The moisture vapor barrier layer overlying the core is relatively thin with a thickness of about 0.10 inches or less; this barrier layer comprises a second composition which is a non-ionomeric polyolefin. The cover material is made of a third composition, for example, one selected from the group consisting of ionomer resins, thermoplastic polyurethane, thermoset polyurethane, thermoplastic polyurea, and thermoset polyurea, thermoplastic rubbers, and thermoset rubbers. The core, moisture vapor barrier layer, and outer cover each comprise a different composition, and the moisture vapor barrier transmission rate of the barrier layer is less than that of the cover material.

Different non-ionomeric polyolefin compositions may be used. For example, the composition may be selected from the group consisting of polyethylene, high density polyethylene (HDPE), low density polyethylene (LDPE), linear low density polyethylene (LLDPE), and ultra low-density polyethylene (ULDPE), and polypropylene, propylene, and polybutene, and copolymers and blends thereof. Ethylene-based copolymers selected from the group consisting of ethylene vinyl acetate (EVA) copolymers, ethylene methyl acrylate (EMA) copolymers, ethylene n-butyl acrylate (EBA) copolymers, ethylene ethyl acrylate (EEA) copolymers, and blends thereof also may be used. Polyolefin copolymers formed using a metallocene single-site catalyst also may be used. In other instances, the polyolefin composition may be selected from ethylene-propylene rubber (EPR) and ethylene propylene diene monomer rubbers (EPDM). The moisture vapor barrier layer may contain filler particulate such as zinc oxide, barium sulfate, calcium oxide, calcium carbonate, and silica, and mixtures thereof.

The golf ball may have different constructions. For example, the core may be a single-piece core having a diameter of at least about 1.58 inches; the barrier layer may have a thickness of less than about 0.010 inches; and the cover may have a thickness of less than about 0.050 inches. In other instances, two-piece cores with an inner core portion having a diameter of about 0.90 inches to about 1.20 inches and an outer core layer having a thickness of about 0.38 to about 0.72 inches diameter may be constructed. This provides a two-piece core having a total diameter of about 1.58 inches to about 1.62 inches.

Different manufacturing methods may be used to make the golf balls of this invention. Preferably, the moisture vapor barrier layer is applied over the core by powder coating or solution coating. Particularly, a moisture vapor barrier layer that encapsulates the inner core may be formed by depositing non-ionomeric polyolefin powder particulate onto the core, wherein the powder particulate has a particle less than about 100 microns, heating the deposited particles to form a continuous coating; and cooling the coating.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

DETAILED DESCRIPTION OF THE PREFERRED EMBODIMENTS

Figure 1:
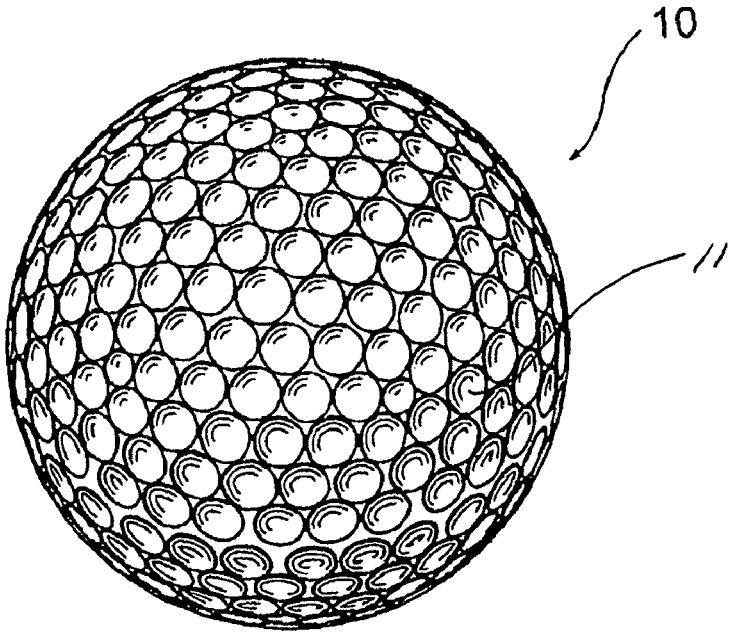
FIG. 1 is a front view of a dimpled golf ball made in accordance with the present invention.
Figure 2:
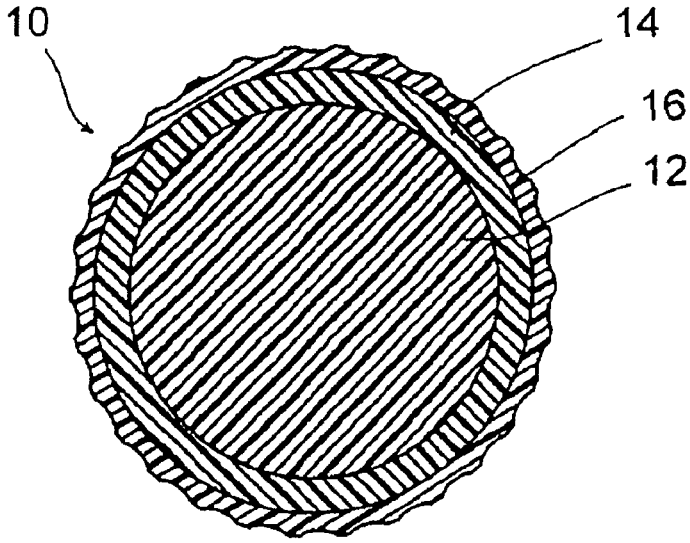
FIG. 2 is cross-sectional view of a golf ball having a single-layered core made in accordance with the present invention.

The present invention relates generally to multi-layered golf balls having at least one core layer, moisture vapor barrier layer, and cover layer. Referring to FIG. 1, a golf ball that can be made in accordance with this invention is generally indicated at (10). Various patterns and geometric shapes of dimples (11) can be used to modify the aerodynamic properties of the golf ball (10). The dimples (11) can be arranged on the surface of the ball (10) using any suitable method known in the art. Dimple patterns and shapes that provide high surface coverage are particularly preferred. Turning to FIG. 2, the golf ball (10) preferably has a solid core (12), moisture vapor barrier layer (14), and a cover layer (16).

Composition of Core

The core of the golf ball may be solid, semi-solid, fluid-filled, or hollow, and the core may have a single-piece or multi-piece structure. A variety of materials may be used to make the core including thermoset compositions such as rubber, styrene butadiene, polybutadiene, isoprene, polyisoprene, trans-isoprene; thermoplastics such as ionomer resins, polyamides or polyesters; and thermoplastic and thermoset polyurethane and polyurea elastomers. In one embodiment, the core is a single-piece made from a natural or synthetic rubber composition such as polybutadiene. In other instances, a two-piece core is constructed; that is, there may be two core layers. For example, an inner core portion may be made of a first base rubber material and an outer core layer, which surrounds the inner core, may be made of a second base rubber material. The respective core pieces may be made of the same or different rubber materials. Cross-linking agents and fillers may be added to the rubber materials.

More particularly, materials for solid cores typically include compositions having a base rubber, a filler, an initiator agent, and a cross-linking agent. The base rubber typically includes natural or synthetic rubber, such as polybutadiene rubber. In one embodiment, the base rubber is 1,4-polybutadiene having a cis-structure of at least 40%. The polybutadiene can be blended with other elastomers such as natural rubber, polyisoprene rubber, styrene-butadiene rubber and/or other polybutadienes. Another suitable rubber that may be used in the core is trans-polybutadiene. This polybutadiene isomer is formed by converting the cis-isomer of the polybutadiene to the trans-isomer during a molding cycle. A soft and fast agent such as pentachlorothiophenol (PCTP) or ZnPCTP can be blended with the polybutadiene. These compounds may also function as cis-to-trans catalyst to convert some cis-1,4 bonds in the polybutadiene into trans 1,4 bonds.

Fillers, which may be used to modify such properties as the specific gravity (density-modifying materials), hardness, weight, modulus, resiliency, compression, and the like may be added to the core composition. Normally, the fillers are inorganic, and suitable fillers include numerous metals or metal oxides, such as zinc oxide and tin oxide, as well as barium sulfate, zinc sulfate, calcium carbonate, barium carbonate, clay, tungsten, tungsten carbide, silica, and mixtures thereof. Fillers may also include various foaming agents or blowing agents, zinc carbonate, regrind (recycled core material typically ground to about 30 mesh or less particle size), high-Mooney-viscosity rubber regrind, and the like. In addition, polymeric, ceramic, metal, and glass microspheres may be used.

Golf balls made in accordance with this invention can be of any size, although the USGA requires that golf ball used in competition have a diameter of at least 1.68 inches and a weight of no greater than 1.62 ounces. For play outside of USGA competition, the golf balls can have smaller diameters and be heavier. For example, the diameter of the golf ball may be in the range of about 1.68 to about 1.80 inches. In one embodiment, the core is a single-piece core having an outside diameter of about 1.20 to about 1.65 inches. Preferably, the single-piece core has a diameter of about 1.62 inches. The core generally makes up a substantial portion of the ball, for example, the core may constitute at least about 90% of the ball. The hardness of the core may vary depending upon the desired properties of the ball. In general, core hardness is in the range of about 30 to about 90 Shore D and more preferably in the range of about 35 to about 60 Shore D. The compression of the core portion is generally in the range of about 70 to about 110 and more preferably in the range of about 80 to about 100. In general, when the ball contains a relatively soft core, the resulting spin rate of the ball is relatively low. The compressive force acting on the ball is less when a club strikes the ball and compresses the cover against a relatively soft core. The club face does not fully interface and grasp the ball's surface and thus the initial spin rate on the ball is lower. On the other hand, when the ball contains a relatively hard core, the resulting spin rate of the ball is relatively high. As the club face strikes the ball, it is able to more fully interface and grasp the ball's surface and thus the initial spin rate of the ball is higher.

Figure 3:
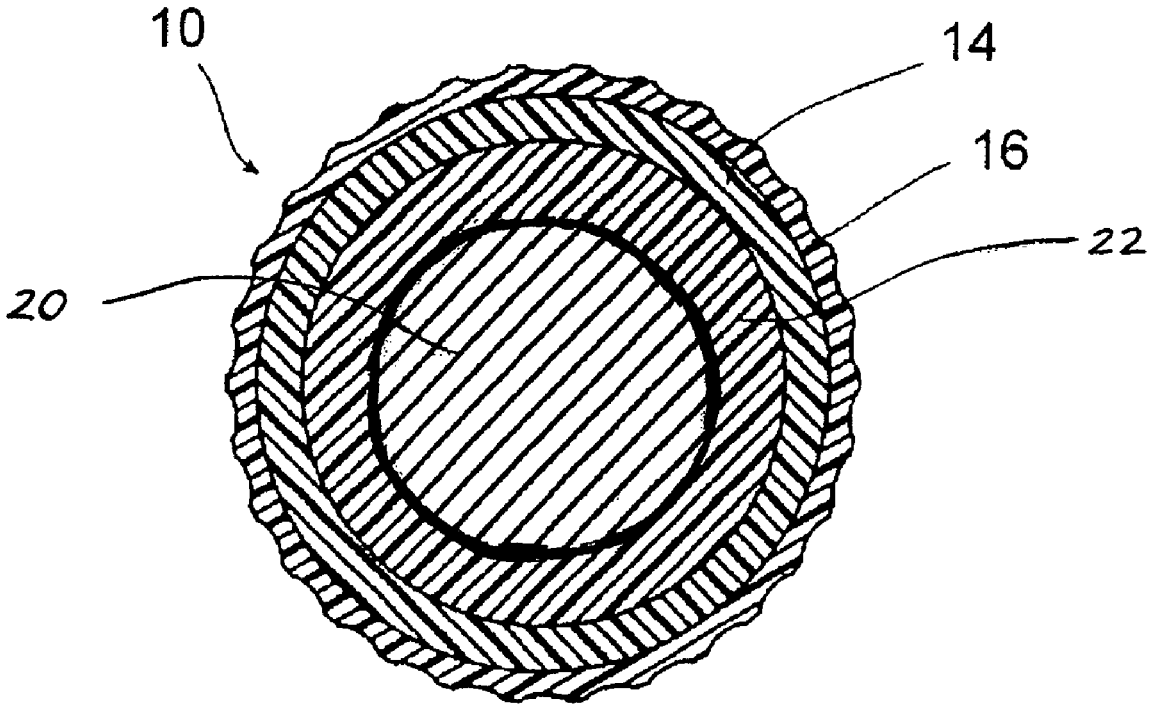
FIG. 3 is a cross-sectional view of a golf ball having a multi-layered core made in accordance with the present invention.

In another embodiment, as shown in FIG. 3, the core (12) may include an inner core portion (20) and surrounding outer core layer (22). This core structure may be referred to as a multi-core or two-piece core. The inner core portion (20) and outer core layer (22) together may be referred to as the "center" of the ball. In such balls having two-piece cores, the inner core portion (20) may have a diameter of about 0.75 to about 1.30 inches, more preferably 1.00 to 1.15 inches, and be relatively soft (that is, it may have a compression of less than about 30.) Meanwhile, the outer core layer (22) may have a thickness of about 0.20 to about 0.60 inches and be relatively hard (compression of about 70 or greater.) That is, the two-piece core or "center" of the ball, which constitutes the inner core portion (20) and outer core layer (22), may have a total diameter of about 1.50 to about 1.64 inches, more preferably 1.510 to 1.620 inches, and a compression of about 80 to about 115, more preferably 85 to 110. The polymers, free-radical initiators, filler, cross-linking agents, and other ingredients may be mixed together to form the single-piece or multi-piece core using conventional techniques. Particularly, a compression or injection molding process can be used to form the solid spheres that will be used as the core.

Composition of Cover

The cover material of the golf ball may be constructed using a variety of materials. The cover material should impart durability, toughness and tear-resistance to the ball. For example, polyurethane/polyurea compositions can be used in the cover layer, because they can provide the cover with high durability as well as a soft feel. In other embodiments, the cover may be made of polymers such as ethylene, propylene, butene-1 or hexane-1 based homopolymers and copolymers including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethylene vinyl alcohol), poly(tetrafluoroethylene) and their copolymers including functional comonomers and blends thereof. Preferably, the cover is made from a different polymeric material than the materials used to make the moisture vapor barrier layer. And, the cover has a moisture vapor transmission rate which is greater than the rate of the moisture barrier layer. That is, moisture tends to penetrate through the cover layer at greater rate than moisture penetrates through the barrier layer. In addition, the moisture vapor rate of the core material as described above, by and in itself, has a moisture vapor transmission rate greater than that of the barrier layer.

In one preferred embodiment, ionomer resins can be used as the cover material. These cross-linked polymers contain inter-chain ionic bonding as well as covalent bonding. The ionomer resins include, for example, a copolymer of ethylene and a vinyl comonomer with an acid group such as methacrylic or acrylic acid. Metal ions such as sodium, lithium, zinc, and magnesium are used to neutralize the acid groups in the polymer. Commercially available ionomer resins are known in the industry and include numerous resins sold under the trademarks, Surlyn® (DuPont) and Escor® and Iotek® (Exxon). These ionomer resins are available in various grades and are identified based on the type of base resin, molecular weight, type of metal ion, amount of acid, degree of neutralization, additives, and other properties.

In a second preferred embodiment, the cover preferably comprises a composition formed from a thermoplastic polyurethane, thermoset polyurethane, thermoplastic polyurea, or thermoset polyurea. More particularly, a polyurea composition can be used as the cover layer. In another version, the cover layer comprises a blend of about 10 to about 90% by weight of the polyurea composition and about 90% to about 10% of a polyurethane composition. In yet another embodiment, the cover layer comprises a blend of about 10 to about 90% by weight of the polyurea composition and about 90% to about 10% of another polymer or other material such as vinyl resins, polyesters, polyamides, and polyolefins.

In one embodiment, the cover has a material hardness of about 30 to about 60 Shore D and more preferably about 40 to about 55 Shore D (tested on a flat slab or button of material using ASTM-D2240 as described in further detail below.) As a general rule, when the ball has a relatively soft cover, the initial spin rate of the ball is relatively high and when the ball has a relatively hard cover, the initial spin rate of the ball is relatively low.

In one preferred embodiment, the core is a single piece core having a diameter of at least about 1.58 inches, preferably at least about 1.60 inches; the barrier layer has a thickness of less than about 0.010 inches; and the cover has a thickness of less than 0.050 inches, preferably less than about 0.040 inches. More preferably, the cover has a thickness of about 0.015 to 0.040 inches.

Alternatively, the core is a two-piece core comprising an inner core portion and outer core layer. The inner core portion preferably has a diameter of about 0.90 inches to about 1.20 inches. The outer core layer preferably has a thickness of about 0.38 to about 0.72 inches. This provides a two-piece core having a total diameter of about 1.58 inches to about 1.62 inches. In such constructions, the barrier layer preferably has a thickness of less than about 0.010 inches, and the cover preferably has a thickness of less than 0.050 inches, preferably less than about 0.040 inches. More preferably, the cover has a thickness of about 0.015 to 0.040 inches.

The golf ball of this invention may have single-, dual-, or multi-layered covers preferably having an overall thickness within a range having a lower limit of 0.010 or 0.020 or 0.025 or 0.030 or 0.040 or 0.045 inches and an upper limit of 0.050 or 0.060 or 0.070 or 0.075 or 0.080 or 0.090 or 0.100 or 0.150 or 0.200 or 0.300 or 0.500 inches. In a particular embodiment, the cover is a single layer having a thickness of from 0.025 inches to 0.035 inches. The cover preferably has a surface hardness of 70 Shore D or less, or 65 Shore D or less, or 60 Shore D or less, or 55 Shore D or less. The cover preferably has a material hardness of 70 Shore D or less, or 65 Shore D or less, or 60 Shore D or less, or 55 Shore D or less.

As discussed above, suitable cover materials include, but are not limited to, ionomer resins and blends thereof (e.g., Surlyn® ionomer resins and DuPont® HPF 1000 and HPF 2000, commercially available from E. I. du Pont de Nemours and Company; Iotek® ionomers, commercially available from ExxonMobil Chemical Company; Amplify® IO ionomers of ethylene acrylic acid copolymers, commercially available from The Dow Chemical Company; and Clarix® ionomer resins, commercially available from A. Schulman Inc.); polyurethanes; polyureas; copolymers and hybrids of polyurethane and polyurea; polyethylene, including, for example, low density polyethylene, linear low density polyethylene, and high density polyethylene; polypropylene; rubber-toughened olefin polymers; acid copolymers, e.g., (meth) acrylic acid, which do not become part of an ionomeric copolymer; plastomers; flexomers; styrene/butadiene/styrene block copolymers; styrene/ethylene-butylene/styrene block copolymers; dynamically vulcanized elastomers; ethylene vinyl acetates; ethylene methyl acrylates; polyvinyl chloride resins; polyamides, amide-ester elastomers, and graft copolymers of ionomer and polyamide, including, for example, Pebax® thermoplastic polyether block amides, commercially available from Arkema Inc; crosslinked trans-polyisoprene and blends thereof; polyester-based thermoplastic elastomers, such as Hytrel®, commercially available from E. I. du Pont de Nemours and Company; polyurethane-based thermoplastic elastomers, such as Elastollan®, commercially available from BASF; synthetic or natural vulcanized rubber; and combinations thereof. In a particular embodiment, the cover is a single layer formed from a composition selected from the group consisting of ionomers, polyester elastomers, polyamide elastomers, and combinations of two or more thereof.

Polyurethanes, polyureas, and blends and hybrids of polyurethane/polyurea are also particularly suitable for forming cover layers. When used as cover layer materials, polyurethanes and polyureas can be thermoset or thermoplastic. Thermoset materials can be formed into golf ball layers by conventional casting or reaction injection molding techniques. Thermoplastic materials can be formed into golf ball layers by conventional compression or injection molding techniques.

Polyurethane cover compositions that can be used include those formed from the reaction product of at least one polyisocyanate and at least one curing agent. The curing agent can include, for example, one or more diamines, one or more polyols, or a combination thereof. The at least one polyisocyanate can be combined with one or more polyols to form a prepolymer, which is then combined with the at least one curing agent. Thus, when polyols are described herein they may be suitable for use in one or both components of the polyurethane material, that is, as part of a prepolymer and in the curing agent. The curing agent includes a polyol curing agent preferably selected from the group consisting of ethylene glycol; diethylene glycol; polyethylene glycol; propylene glycol; polypropylene glycol; lower molecular weight polytetramethylene ether glycol; 1,3-bis(2-hydroxyethoxy)benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol; 1,5-pentanediol; 1,6-hexanediol; resorcinol-di-(β-hydroxyethyl)ether; hydroquinone-di-(β-hydroxyethyl) ether; trimethylol propane; and combinations thereof.

Suitable polyurethane cover compositions also include those formed from the reaction product of at least one isocyanate and at least one curing agent or the reaction product of at least one isocyanate, at least one polyol, and at least one curing agent. Preferred isocyanates include those selected from the group consisting of 4,4'-diphenylmethane diisocyanate, polymeric 4,4'-diphenylmethane diisocyanate, carbodiimide-modified liquid 4,4'-diphenylmethane diisocyanate, 4,4'-dicyclohexylmethane diisocyanate, p-phenylene diisocyanate, toluene diisocyanate, isophoronediisocyanate, p-methylxylene diisocyanate, m-methylxylene diisocyanate, o-methylxylene diisocyanate, and combinations thereof. Preferred polyols include those selected from the group consisting of polyether polyol, hydroxy-terminated polybutadiene, polyester polyol, polycaprolactone polyol, polycarbonate polyol, and combinations thereof. Preferred curing agents include polyamine curing agents, polyol curing agents, and combinations thereof. Polyamine curing agents are particularly preferred. Preferred polyamine curing agents include, for example, 3,5-dimethylthio-2,4-toluenediamine, or an isomer thereof; 3,5-diethyltoluene-2,4-diamine, or an isomer thereof; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline);

trimethylene glycol-di-p-aminobenzoate; polytetramethyleneoxide-di-p-aminobenzoate; N,N'-dialkyldiamino diphenyl methane; p,p'-methylene dianiline; phenylenediamine; 4,4'-methylene-bis-(2-chloroaniline); 4,4'-methylene-bis-(2,6-diethylaniline); 4,4'-diamino-3,3'-diethyl-5,5'-dimethyl diphenylmethane; 2,2',3,3'-tetrachloro diamino diphenylmethane; 4,4'-methylene-bis-(3-chloro-2,6-diethylaniline); and combinations thereof.

The cover composition is not limited by the use of a particular polyisocyanate. Suitable polyisocyanates include, but are not limited to, 4,4'-diphenylmethane diisocyanate ("MDI"), polymeric MDI, carbodiimide-modified liquid MDI, 4,4'-dicyclohexylmethane diisocyanate ("$H_{12}$MDI"), p-phenylene diisocyanate ("PPDI"), toluene diisocyanate ("TDI"), 3,3'-dimethyl-4,4'-biphenylene diisocyanate ("TODI"), isophoronediisocyanate ("IPDI"), hexamethylene diisocyanate ("HDI"), naphthalene diisocyanate ("NDI"); xylene diisocyanate ("XDI"); para-tetramethylxylene diisocyanate ("p-TMXDI"); meta-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate ("TMDI"), tetracene diisocyanate, naphthalene diisocyanate, anthracene diisocyanate; and combinations thereof. Polyisocyanates are known to those of ordinary skill in the art as having more than one isocyanate group, e.g., di-, tri-, and tetra-isocyanate. Preferably, the polyisocyanate is selected from MDI, PPDI, TDI, and combinations thereof. More preferably, the polyisocyanate includes MDI. It should be understood that, as used herein, the term "MDI" includes 4,4'-diphenylmethane diisocyanate, polymeric MDI, carbodiimide-modified liquid MDI, combinations thereof and, additionally, that the diisocyanate employed may be "low free monomer," understood by one of ordinary skill in the art to have lower levels of "free" monomer isocyanate groups than conventional diisocyanates, i.e., the compositions of the invention typically have less than about 0.1% free monomer groups. Examples of "low free monomer" diisocyanates include, but are not limited to Low Free Monomer MDI, Low Free Monomer TDI, and Low Free Monomer PPDI.

The at least one polyisocyanate should have less than 14% unreacted NCO groups. Preferably, the at least one polyisocyanate has no greater than 8.5% NCO, more preferably from 2.5% to 8.0%, even more preferably from 4.0% to 7.2%, and most preferably from 5.0% to 6.5%.

The cover composition is not limited by the use of a particular polyol. In one embodiment, the molecular weight of the polyol is from about 200 to about 6000. Exemplary polyols include, but are not limited to, polyether polyols, hydroxy-terminated polybutadiene (including partially/fully hydrogenated derivatives), polyester polyols, polycaprolactone polyols, and polycarbonate polyols. Particularly preferred are polytetramethylene ether glycol ("PTMEG"), polyethylene propylene glycol, polyoxypropylene glycol, and combinations thereof. The hydrocarbon chain can have saturated or unsaturated bonds and substituted or unsubstituted aromatic and cyclic groups. Preferably, the polyol includes PTMEG. Suitable polyester polyols include, but are not limited to, polyethylene adipate glycol, polybutylene adipate glycol, polyethylene propylene adipate glycol, ortho-phthalate-1,6-hexanediol, and combinations thereof. The hydrocarbon chain can have saturated or unsaturated bonds, or substituted or unsubstituted aromatic and cyclic groups. Suitable polycaprolactone polyols include, but are not limited to 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and combinations thereof. The hydrocarbon chain can have saturated or unsaturated bonds, or substituted or unsubstituted aromatic and cyclic groups. Suitable polycarbonates include, but are not limited to, polyphthalate carbonate. The hydrocarbon chain can have saturated or unsaturated bonds, or substituted or unsubstituted aromatic and cyclic groups.

Polyamine curatives are also suitable for use in the curing agent of polyurethane compositions and have been found to improve cut, shear, and impact resistance of the resultant balls. Preferred polyamine curatives include, but are not limited to 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline ("MDA"); m-phenylenediamine ("MPDA"); 4,4'-methylene-bis-(2-chloroaniline) ("MOCA"); 4,4'-methylene-bis-(2,6-diethylaniline); 4,4'-diamino-3,3'-diethyl-5,5'-dimethyl diphenylmethane; 2,2',3,3'-tetrachloro diamino diphenylmethane; 4,4'-methylene-bis-(3-chloro-2,6-diethylaniline); trimethylene glycol di-p-aminobenzoate; and combinations thereof. Preferably, the curing agent includes 3,5-dimethylthio-2,4-toluenediamine and isomers thereof, such as ETHACURE 300. Suitable polyamine curatives, which include both primary and secondary amines, preferably have weight average molecular weights ranging from about 64 to about 2000.

At least one of a diol, triol, tetraol, or hydroxy-terminated curative may be added to the polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy)benzene; 1,3-bis-[2-(2-hydroxyethoxy)ethoxy]benzene; 1,3-bis-{2-[2-(2-hydroxyethoxy) ethoxy]ethoxy}benzene; 1,4-butanediol; 1,5-pentanediol; 1,6-hexanediol; resorcinol-di-(4-hydroxyethyl)ether; hydroquinone-di-(4-hydroxyethyl)ether; and combinations thereof. Preferred hydroxy-terminated curatives include ethylene glycol; diethylene glycol; 1,4-butanediol; 1,5-pentanediol; 1,6-hexanediol, trimethylol propane, and combinations thereof. Preferably, the hydroxy-terminated curative has a molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

Any method known to one of ordinary skill in the art may be used to combine the polyisocyanate, polyol, and curing agent. One commonly employed method, known in the art as a one-shot method, involves concurrent mixing of the polyisocyanate, polyol, and curing agent. This method results in a mixture that is inhomogeneous (more random) and affords the manufacturer less control over the molecular structure of the resultant composition. A preferred method of mixing is known as a pre-polymer method. In this method, the polyisocyanate and the polyol are mixed separately prior to addition of the curing agent. This method affords a more homogeneous mixture resulting in a more consistent polymer composition.

Suitable polyurethanes are further disclosed, for example, in U.S. Pat. Nos. 5,334,673, 6,506,851, 6,756,436, 6,867,279, 6,960,630, and 7,105,623, the entire disclosures of which are hereby incorporated herein by reference. Suitable polyureas are further disclosed, for example, in U.S. Pat. Nos. 5,484,870 and 6,835,794, and U.S. Patent Application No. 60/401,047, the entire disclosures of which are hereby incorporated herein by reference. Suitable polyurethane-urea cover materials include polyurethane/polyurea blends and copolymers comprising urethane and urea segments, as disclosed in U.S. Patent Application Publication No. 2007/0117923, the entire disclosure of which is hereby incorporated herein by reference.

Cover compositions may include one or more filler(s), such as coloring agents, fluorescent agents, whitening agents, antioxidants, dispersants, UV absorbers, light stabilizers, plasticizers, surfactants, compatibility agents, foaming agents, reinforcing agents, release agents, and the like.

Suitable cover materials and constructions also include, but are not limited to, those disclosed in U.S. Patent Application Publication No. 2005/0164810, U.S. Pat. Nos. 5,919,100, 6,117,025, 6,767,940, and 6,960,630, and PCT Publications WO00/23519 and WO00/29129, the entire disclosures of which are hereby incorporated herein by reference.

In a particular embodiment, the cover is a single layer, preferably formed from castable or reaction injection moldable thermosetting polyurethane, polyurea, or copolymer or hybrid of polyurethane/polyurea, and preferably has a surface hardness of 60 Shore D or less; a material hardness of 60 Shore D or less; and a thickness of 0.02 inches or greater or 0.03 inches or greater or 0.04 inches or greater; or a thickness within a range having a lower limit of 0.010 or 0.015 or 0.020 inches and an upper limit of 0.035 or 0.040 or 0.050 inches.

Composition of Moisture Vapor Barrier Layer

The moisture vapor barrier layer is disposed immediately around the core to prevent liquid and/or vapor from penetrating therein. That is, the barrier layer encapsulates and envelopes the core. The overlying moisture vapor barrier is positioned between the core and cover layer. The moisture barrier layer has a moisture vapor transmission rate that is lower than that transmission rate of both the outer cover and the core. This means that moisture will penetrate through the cover layer, but the interceding moisture barrier layer will minimize moisture penetration into the core. The core material, by and in itself, has a relatively high moisture vapor transmission rate similar to the transmission rate of the outer cover. More preferably, the moisture vapor barrier layer, comprising the non-ionomeric polyolefin, has a moisture vapor transmission rate less than the moisture vapor transmission rate of an ionomer resin such as Surlyn®, which is in the range of about 0.45 to about 0.95 grams·mm/m$^2$·day. The moisture vapor transmission rate is defined as the mass of moisture vapor that diffuses into a material of a given thickness per unit area per unit time. The preferred standards of measuring the moisture vapor transmission rate include ASTM F1249-90 entitled "Standard Test Method for Water Vapor Transmission Rate Through Plastic Film and Sheeting Using a Modulated Infrared Sensor," and ASTM F372-94 entitled "Standard Test Method for Water Vapor Transmission Rate of Flexible Barrier Materials Using an Infrared Detection Technique," among others.

In the present invention, it has been found that no substantial amount of liquid and/or vapor will pass through the interface between the moisture barrier layer and core as compared to an untreated core when exposed to similar conditions. By encapsulating the core in a moisture vapor barrier layer of this invention, the core is protected from liquid and/or vapor. As a result, the optimum properties of such golf balls (for example, high coefficient of restitution) are not substantially reduced when the balls are stored in humid conditions as opposed to golf balls that do not contain the inventive moisture vapor barrier layer. Under standard humidity conditions for testing, the temperature would be in the range of about 100° to about 120° F. and the relative humidity would be in the range of about 70% to about 90% for six weeks.

The moisture vapor barrier layer of this invention preferably has a thickness of less than 0.010 inches. Particularly, the thickness of the layer is in the range of about 0.0001 to about 0.010 inches, more preferably in the range of about 0.0005 to about 0.005 inches, and most preferably in the range of about 0.001 to about 0.004 inches.

The moisture barrier layer comprises a non-ionomeric polyolefin composition. Such compositions include, for example, those compounds selected from the group consisting of polyethylene, high density polyethylene (HDPE), low density polyethylene (LDPE), linear low density polyethylene (LLDPE), and ultra low-density polyethylene (ULDPE), and polypropylene, propylene, and polybutene, and copolymers and blends thereof. These copolymers can include, for example, ethylene-based copolymers such as ethylene vinyl acetate (EVA) copolymers, ethylene methyl acrylate (EMA) copolymers, ethylene n-butyl acrylate (EBA) copolymers, ethylene ethyl acrylate (EEA) copolymers, and other ethylene alkyl acrylate copolymers.

The term, copolymers is meant to include copolymers formed by polymerizing two monomers together, terpolymers that are formed by polymerizing three monomers together, and products that are formed by polymerizing more than three monomers together. Random copolymers and block copolymers can be used in accordance with this invention. By the term, non-ionomeric polyolefins, it is meant to include polyolefin copolymers other than ionomeric copolymers, which include ethylene copolymers formed by polymerizing ethylene with a vinyl monomer having an acid group such as methacrylic or acrylic acid and partially neutralized with salts of sodium, lithium, zinc, and magnesium, and the like.

Polyolefin copolymers, which are formed using metallocene single-site catalyst (or other single-site catalysts), also can be used. These polyolefin copolymers can be formed by polymerizing ethylene in combination with other monomers such as butene, hexene, and octene in a high pressure process in the presence of catalysts. Such metallocene-catalyzed polyolefins are commercially available and sold under such trademarks as Fusabond™ (DuPont), and Affinity™, Engage™, Amplify™, Enlite™, or Flexomer™ (Dow Chemical). In one preferred embodiment, the polyolefin composition used to form the moisture vapor barrier layer comprises an Amplify™ maleic anhydride grafted ethylene polymer.

Other suitable polyolefins include very low molecular weight versions such as waxes (for example, "AC" material, available from Honeywell Specialty Wax and Additives); oxidized polyethylene or polypropylene as well as high molecular weight versions (for example, ultra high molecular weight polyethylene (UHMWPE)), and the like. Polyethylene vinyl acetate, ethylene vinyl alcohol, ethylene carbon monoxide, and the like also may be used. Ethylene and propylene copolymers such as ethylene-propylene rubber (EPR) and ethylene propylene diene monomer rubbers (EPDM) also may be used. Olefin block copolymers such as those sold by Dow Chemical under the trademark, Infuse™ also may be used. Chlorinated polyethylenes such as those sold by Dow Chemical under the tradename, Tyrin™ also may be used.

Methods of Forming the Moisture Vapor Barrier Layer

The polyolefin compositions may be applied as a powder coating to form the moisture vapor barrier layer. In one version of this method, the polyolefin pellets are mechanically ground to obtain a fine powder particulate suitable for electrostatic powder coating. Alternatively, the polyolefin powder can be prepared by dissolving the polyolefin in a suitable solvent at a high temperature and then cooling it to form a fine precipitate, followed by separating and drying. The polyolefin particles preferably have a particle size of less than 500 microns and more preferably less than 100 microns and most preferably about 10 to about 50 microns. If the powder is made up of larger particulate, it tends to form a rougher coating.

Any powder coating method that effectively deposits the polyolefin particles onto the surface of the core to form a continuous coating can be used in accordance with this invention. In one preferred embodiment, the polyolefin powder is applied to the core by electrostatically spraying. For example, an electrostatic ejector gun that imparts a positive electric charge on the powder may be used. The powder is sprayed towards the core by compressed air spraying. A powerful electrostatic charge causes the particles to accelerate towards the core so they may be deposited thereon. This is followed by heat fusing or baking the deposited particles at a temperature in the range of about 300° to about 500° F. for about one to about thirty minutes to form a continuous coating. The powder melts to form a uniform film coating and then it is cooled. Alternatively, the core may be sprayed with a slurry of the polyolefin composition and then heat fused. Other time-temperature cycles can be used, provided that the temperature is sufficient to melt the particles and form a continuous coating.

The coating of the moisture vapor barrier layer onto the core is preferably achieved by a powder coating method. The powder coating method provides a continuous uniform coating of the polyolefin composition. Moreover, in the powder coating method, the polyolefin composition is heated locally and does not materially alter the properties of the core material. That is, the inherent properties of the core effectively remain unchanged.

It is further recognized that other methods for applying the polyolefin composition over the core may be used in accordance with this invention. For example, a solution coating method may be used. Typically, in such a process, the coating material is dissolved in an appropriate solvent, the solution is deposited on the core's surface and thereafter the solvent is removed. Suitable solvents for a solution coating of polyolefin include any hydrocarbon solvent or a blend of a hydrocarbon solvent with a polar solvent. Preferred hydrocarbon solvents include pentane, hexane, heptane, octane, dodecane, and the like and aromatic hydrocarbons such a toluene, xylene, benzene, naphthalene, mineral spirits or mineral turpentine spirits, petroleum ethers, cycloheptane, cyclohexane, cyclohexene, and blends thereof. Preferred polar solvent include acetone, tetrahydrofuran (THF), methyl acetate, ethyl acetate, butyl acetate, methyl amyl ketone, methyl ethyl ketone, methylene chloride, ethanol, methanol, propanol, dimethyl formamide, and the like, and blends thereof. Most preferred is toluene or a blend of 40-90% toluene with 10-60% THF. Preferably, the solvent is at room temperature or greater, most preferably from about 70 to 200° F. Once the core is core is coated with the solution, the coated core may be subjected to elevated temperatures or reduced atmospheric pressure (for example, vacuum) to remove the solvent component of the solution.

In another method, the barrier layer composition may be pre-formed into semi-cured shells. Specifically, a quantity of the barrier material is placed into a compression mold and molded under sufficient pressure, temperature and time to produce semi-cured, semi-rigid half-shells. The half-shells are then place around a core or a sub-assembly and cured in a second compression mold to reach the desirable size. In yet another method, the solid composition of the barrier layer is dispersed in a non-aqueous solvent system, and the dispersion is sprayed on the cores and dried.

Although it is preferred that the polyolefin composition be applied as a solution or powder coating, whereby the polyolefin materials are not cross-linked and the composition simply forms a thermoplastic coating, it is recognized that the coating may be treated in other instances. For example, the coating may be cross-linked using peroxide and heat, high-energy radiation, ultraviolet (UV) light radiation and the like prior to application of the cover layer.

The polyolefin composition used to form the moisture barrier layer may contain any suitable additive, for example, wetting agents, coloring agents, optical brighteners, whitening agents such as titanium dioxide and zinc oxide, UV absorbers, hindered amine light stabilizers, defoaming agents, processing aids, surfactants, antioxidants, stabilizers, softening agents, plasticizers, impact modifiers, foaming agents, density-adjusting fillers, reinforcing materials, and compatibilizers. The density-adjusting fillers can be added to modify the modulus, tensile strength, and other properties of the compositions. Examples of useful fillers include zinc oxide, barium sulfate, calcium oxide, calcium carbonate, and silica. Generally, the additives will be present in the composition in an amount between about 1 and about 70 weight percent based on the total weight of the composition depending upon the desired properties.

Hydrophobic microparticles including fibers; whiskers; metal flakes; micaceous particles; or nanoparticles can be added to the polyolefin composition to create a tortuous (random and non-linear) path across the barrier layer to reduce its moisture vapor transmission rate. The term, microparticles, refers to particulates having a particle size of about 1 micron to about 200 microns. Nanoparticles refer to particles having an average particle size less than 1 micron. Suitable microparticles and nanoparticles can be pigmented or non-pigmented, and include fibers, whiskers, and flaked metals such as aluminum flakes, iron oxide flakes, copper flakes, bronze flakes, and the like, and mixtures thereof. Preferred metal flakes include aluminum flakes and, more specifically, aluminum oxide flakes. Microparticles sized preferably about 5 microns to about 50 microns may be used. The aspect ratio of the flakes preferably may be about 50 to about 10,000.

After the moisture barrier layer is formed by coating the core with the polyolefin composition, an outer cover material is applied over the coated core. The outer cover layer encapsulates the moisture barrier layer. The outer cover layer may be applied by any suitable technique injection molding, compression molding, casting, reaction injection molding (RIM), vacuum forming, powder coating, and the like. Normally, compression and injection molding techniques are used to make thermoplastic cover materials, while RIM, liquid injection molding, and casting are used to make thermoset cover materials.

For example, in a casting process, a polyurethane and/or polyurea composition may be dispensed into the cavity of an upper mold member. This first mold half has a hemispherical structure. Then, the cavity of a corresponding lower mold member is filled with the polyurea mixture. This second mold half also has a hemispherical structure. A ball cup holds the golf ball (core and overlying casing layer) under vacuum. After the polyurea mixture in the first mold half has reached a semi-gelled or gelled sate, the pressure is removed and the golf ball is lowered into the upper mold half containing the polyurea mixture. Then, the first mold half is inverted and mated with the second mold half containing polyurea mixture which also has reached a semi-gelled or gelled state. The polyurea mixtures, contained in the mold members that are mated together, form the golf ball cover. The mated first and second mold halves containing the polyurea mixture and golf ball center may be next heated so that the mixture cures and hardens. Then, the golf ball is removed from the mold and allowed to cool as needed.

Preferably, a polyurethane or polyurea cover is disposed immediately about the barrier layer so that the two are contiguous with each other. Once the outer cover layer is applied over the moisture vapor barrier layer, it helps enhance the sealing effect. This combination of cover layer and moisture vapor barrier layer further enhances the sealing of the inner core of the ball. In effect, the cover layer is tied to the moisture vapor barrier layer and this composite structure provides a tight seal. There is a tight interface between the outer cover layer and moisture barrier layer as well as the inner core and moisture barrier layer. Moisture penetration into the center of the ball is minimized by this seal.

Test Methods

Compression In the present invention, "compression" is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Cores having a very low stiffness will not cause the spring to deflect by more than 1.25 mm and therefore have a zero compression measurement. The Atti compression tester is designed to measure objects having a diameter of 1.680 inches; thus, smaller objects, such as golf ball cores, must be shimmed to a total height of 1.680 inches to obtain an accurate reading. Conversion from Atti compression to Riehle (cores), Riehle (balls), 100 kg deflection, 130-10 kg deflection or effective modulus can be carried out according to the formulas given in J. Dalton.

Coefficient of Restitution (COR) In the present invention, COR is determined according to a known procedure, wherein a golf ball or golf ball subassembly (for example, a golf ball core) is fired from an air cannon at two given velocities and a velocity of 125 ft/s is used for the calculations. Ballistic light screens are located between the air cannon and steel plate at a fixed distance to measure ball velocity. As the ball travels toward the steel plate, it activates each light screen and the ball's time period at each light screen is measured. This provides an incoming transit time period which is inversely proportional to the ball's incoming velocity. The ball makes impact with the steel plate and rebounds so it passes again through the light screens. As the rebounding ball activates each light screen, the ball's time period at each screen is measured. This provides an outgoing transit time period which is inversely proportional to the ball's outgoing velocity. The COR is then calculates as the ratio of the ball's outgoing transit time period to the ball's incoming transit time period ($COR=V_{out}/V_{in}=T_{in}/T_{out}$).

Surface Hardness The surface hardness of a golf ball layer is obtained from the average of a number of measurements taken from opposing hemispheres, taking care to avoid making measurements on the parting line of the core or on surface defects such as holes or protrusions. Hardness measurements are made pursuant to ASTM D-2240 "Indentation Hardness of Rubber and Plastic by Means of a Durometer." Because of the curved surface of the golf ball layer, care must be taken to ensure that the golf ball or golf ball subassembly is centered under the durometer indentor before a surface hardness reading is obtained. A calibrated digital durometer, capable of reading to 0.1 hardness units, is used for all hardness measurements and is set to take hardness readings at 1 second after the maximum reading is obtained. The digital durometer must be attached to and its foot made parallel to the base of an automatic stand. The weight on the durometer and attack rate conforms to ASTM D-2240. It should be understood that there is a fundamental difference between "material hardness" and "hardness as measured directly on a golf ball." For purposes of the present invention, material hardness is measured according to ASTM D2240 and generally involves measuring the hardness of a flat "slab" or "button" formed of the material. Surface hardness as measured directly on a golf ball (or other spherical surface) typically results in a different hardness value. The difference in "surface hardness" and "material hardness" values is due to several factors including, but not limited to, ball construction (that is, core type, number of cores and/or cover layers, and the like); ball (or sphere) diameter; and the material composition of adjacent layers. It also should be understood that the two measurement techniques are not linearly related and, therefore, one hardness value cannot easily be correlated to the other.

It is understood that the multi-layered golf balls having a moisture barrier described and illustrated herein represent only presently preferred embodiments of the invention. It is appreciated by those skilled in the art that various changes and additions can be made to such golf balls without departing from the spirit and scope of this invention. It is intended that all such embodiments be covered by the appended claims.

We claim:

1. A method of manufacturing a golf ball having a moisture vapor barrier layer, comprising the steps of:

a) forming a core;

b) forming a moisture vapor barrier layer that encapsulates the inner core by depositing non-ionomeric polyolefin powder particulate onto the core, the powder particulate having a particle size less than about 100 microns, heating the deposited particles to form a continuous coating, and cooling the coating; and c) forming a cover layer over the moisture vapor barrier layer by powder coating the composition for the cover layer directly onto the moisture vapor barrier layer.

2. The method of claim 1, wherein the core comprises polybutadiene.

3. The method of claim 1, wherein the core is a single piece core having a diameter of at least about 1.58 inches; the barrier layer has a thickness of less than about 0.010 inches; and the cover has a thickness of less than about 0.050 inches.

4. The method of claim 1, wherein the polyolefin composition is selected from ethylene-propylene rubber (EPR) and ethylene propylene diene monomer rubbers (EPDM).

5. The method of claim 1, wherein the moisture barrier vapor layer further comprises a filler selected from the group consisting of zinc oxide, barium sulfate, calcium oxide, calcium carbonate, and silica, and mixtures thereof.

* * * * *